US005551131A

United States Patent [19]

Anscher

[11] Patent Number: 5,551,131

[45] Date of Patent: Sep. 3, 1996

[54] BUCKLE WHICH IS RELEASABLE BY DEPRESSION OF A HINGED MEMBER AND HAVING IMPROVED LOCKING CAPABILITY

[75] Inventor: Joseph Anscher, Muttontown, N.Y.

[73] Assignee: National Molding Corp., Farmingdale, N.Y.

[21] Appl. No.: 356,750

[22] Filed: Dec. 15, 1994

[51] Int. Cl.[6] ..... A44B 11/26

[52] U.S. Cl. ..... 24/614; 24/606; 24/625

[58] Field of Search ..... 24/614–616, 625, 24/633, 606

[56] References Cited

U.S. PATENT DOCUMENTS

| | | | |
|---|---|---|---|
| D. 289,622 | 5/1987 | Crowle et al. | D11/216 |
| D. 343,144 | 1/1994 | Matoba | D11/216 |
| 4,679,282 | 7/1987 | Feng | 24/614 |
| 4,802,262 | 2/1989 | Kasai | 24/606 |
| 4,864,700 | 9/1989 | Kasai | 24/573 |
| 4,866,819 | 9/1989 | Kasai | 24/614 |
| 4,894,890 | 1/1990 | Kasai | 24/573 |
| 4,977,650 | 12/1990 | Ida | 24/614 |
| 5,222,279 | 6/1993 | Frano et al. | 24/625 |

FOREIGN PATENT DOCUMENTS 2262962 7/1993 United Kingdom .

*Primary Examiner*—James R. Brittain
*Attorney, Agent, or Firm*—Kenyon & Kenyon

[57] ABSTRACT

A multiple-piece buckle having a socket member and at least one plug member, wherein the plug member has a resilient tongue having a pair of laterally projecting wings or latches near a distal end thereof, and wherein the socket member includes a pair of lugs which are adapted to engage the latches to lock the plug member into the socket member. The socket member includes a hinged plate or button in a top face thereof which can be depressed to force the wings of the resilient tongue of the plug member away from the lugs to release the wings so as to disengage the buckle.

19 Claims, 9 Drawing Sheets

BUCKLE WHICH IS RELEASABLE BY DEPRESSION OF A HINGED MEMBER AND HAVING IMPROVED LOCKING CAPABILITY

BACKGROUND OF THE INVENTION

1. Field of the Invention

The invention relates generally to multiple piece buckles having at least one male member and one female member which are disengaged by depressing a resilient flap or the like on one of the members.

2. Description of Related Art

Assorted two-piece buckles are known in the art. These buckles typically include a female receptacle or socket member which is engageable with a male latch or plug member. One or both of the members adjustably or fixedly holds a strap or belt around crossbars or the like. One particularly common form of a two-piece buckle is a so-called side-release buckle in which the plug member includes a pair of legs which, when inserted into the socket member, flex inwardly and slide past opposing stop members (e.g., latches) in the socket until they snap fit into respective side openings in the socket. The stop members are typically inwardly projecting surfaces of the socket member around the periphery of the opening which engage with shoulders defined on the outside edges of the legs of the male member. The two buckle pieces are unlocked and disengaged by squeezing the legs of the male member through the openings in the female member between the thumb and forefinger, thereby freeing the shoulders defined in the legs from the respective stop members in the female member and allowing the two buckle pieces to become separated.

An example of such a side-release type buckle is disclosed in U.S. Pat. No. 4,150,464. It can be seen that the female member defines apertures in opposing side walls thereof for engagement with shoulders of the latch arms belonging to the male member. The shoulders are positioned on the outside side surfaces of the latch arms and engage the stop members which project inwardly from the side walls of the female member. However, it has been recognized that with this arrangement, the buckle is susceptible to failure during heavy loading for the following reasons. The load in the latch arms which urges removal of the latch arms from the female member is ordinarily directed along the longitudinal axis or center line of each latch arm. However, the line which represents the location of the latch resistance or engagement force opposing the load is offset from center line, because it is directed between the side walls of the female member and the shoulders on the outer side surfaces of the latch arms. Accordingly, it has been recognized that during loading on the buckle, a torque develops between the latch arms and the female member which tends to cause inward rotation of the latch arms, and consequently release of the buckle (see also U.S. Pat. No. 5,222,279 (col. 1, 1. 43–48). U.S. Pat. No. 5,222,279 proposes a solution to this problem for a side-release type buckle.

Notwithstanding the above-described drawback, side release buckles have found wide use in luggage, baggage, sporting equipment, etc. . . . However, they have not found universal acceptance because in certain applications it is desirable to be able to release the buckle pieces in a different manner (i.e., without squeezing the buckle between opposite sides with two fingers). For example, in certain applications where someone wearing mittens may find it difficult to open a side release buckle, it is desirable to have a buckle which can be released with less dexterity.

Accordingly, two-piece buckles have been developed which are releasable by depressing a button or the like on a top face of one of the buckle members. Examples of these types of buckles are described in U.S. Pat. Nos. 4,802,262; 4,864,700; 4,866,819; and 4,894,890 to Kasai. The plug member of these buckles includes a locking lug near the distal end thereof which, when inserted into the socket member, slides over a stopper crossbar in the socket. Once it is beyond the stopper bar, the locking lug snaps into place behind it thereby preventing the plug member from being removed. The two pieces of the buckle are disengaged by depressing a resilient flap located in the center region of a top or bottom face of the socket member. The inside surface of the flap has a releasing lug which acts on the locking lug of the plug member to push it away from the stopper bar, thereby freeing the plug member from the socket member. Thus, these types of buckles merely require one finger to push down on the flap or button to disengage the two pieces.

However, one drawback to these push button-type buckles is that they generally have a complex structure as compared to side release buckles. Another drawback is that they often do not exhibit the same level of strength or holding power as side-release buckles. The latch or shoulder resistance force which opposes the load force on a side-release buckle, as described above, is typically greater than the locking lug force which opposes the load on a push button type buckle.

Accordingly, it would be desirable to combine the great latch resistance or shoulder resistance force of a side-release buckle with the single push button or flap releasing mechanism of a push button type buckle. It would also be desirable to provide a push button type buckle wherein the engagement force between the male and female members, which holds the two buckle pieces together against the load force, is aligned in all directions with the load force, in order to further improve the locking strength of the buckle.

SUMMARY OF THE INVENTION

It is an object of the invention to provide a multiple piece buckle which is released by depressing a single flap or hinged member integral with a top face of the buckle.

It is a further object of the invention to provide a push button buckle as described in the preceding paragraph wherein the engagement force between the male and female members of the buckle, opposing the load force, is aligned in all directions with the load force acting on the buckle.

It is a further object of the invention to provide a push button type buckle having an improved locking mechanism as compared to the push button buckles of the prior art.

It is another specific object of the invention to provide a multiple piece buckle having at least one male member and one female member wherein the male member includes a tongue having laterally projecting latches or shoulders which are engageable with lugs or projection members in the female member, wherein the buckle is released by depressing a hinged member on a face of the female member to result in movement of the latches clear of the lugs.

These and other objects of the invention are achieved by a buckle having a socket member and at least one plug member, wherein the plug member has a resilient tongue having a pair of laterally projecting wings or latches near a distal end thereof. Each wing defines a shoulder along its proximal side. The socket member includes a pair of lugs which are adapted to engage the shoulders defined by the wings to lock the plug member in the socket member. The socket member includes a hinged plate or button in a top face thereof which can be depressed to force the resilient tongue of the plug member away from the lugs to release the shoulders from the lugs and disengage the locking mechanism of the buckle. The plug member may then be decoupled from the socket member. The plug member can include a pair of legs which run along opposite sides of the tongue and cooperate with side surfaces inside the socket member to guide the plug and properly orient it in the socket upon insertion. To facilitate release of the plug member from the socket, the lugs in the socket are preferably canted in a direction to cause the wings of the resilient tongue of the plug to slide down the canted surface in a direction away from the socket member. The surface of the resilient tongue which engages the locking lugs may also be canted to facilitate releasability, whereby the canted surfaces of the locking lugs and tongue cooperate to allow for easy sliding of the wings over the lugs.

In another embodiment of the invention, the configuration of the tongue is modified. The tongue is divided into two separate tongues which run along opposite sides of the plug. Each tongue is configured to define a hook at or near its distal end for engaging the locking lugs in the socket member. Since the tongues run along opposite sides of the plug member, the tongues also function to guide and properly orient the plug in the socket.

BRIEF DESCRIPTION OF THE DRAWINGS

Various other objects, features and advantages of the present invention will be more fully appreciated from the following detailed description of the preferred embodiments, when considered in connection with the accompanying drawings, in which like reference characters designate like or corresponding parts throughout the several views, and wherein.

DETAILED DESCRIPTION OF THE INVENTION

Figure 1:
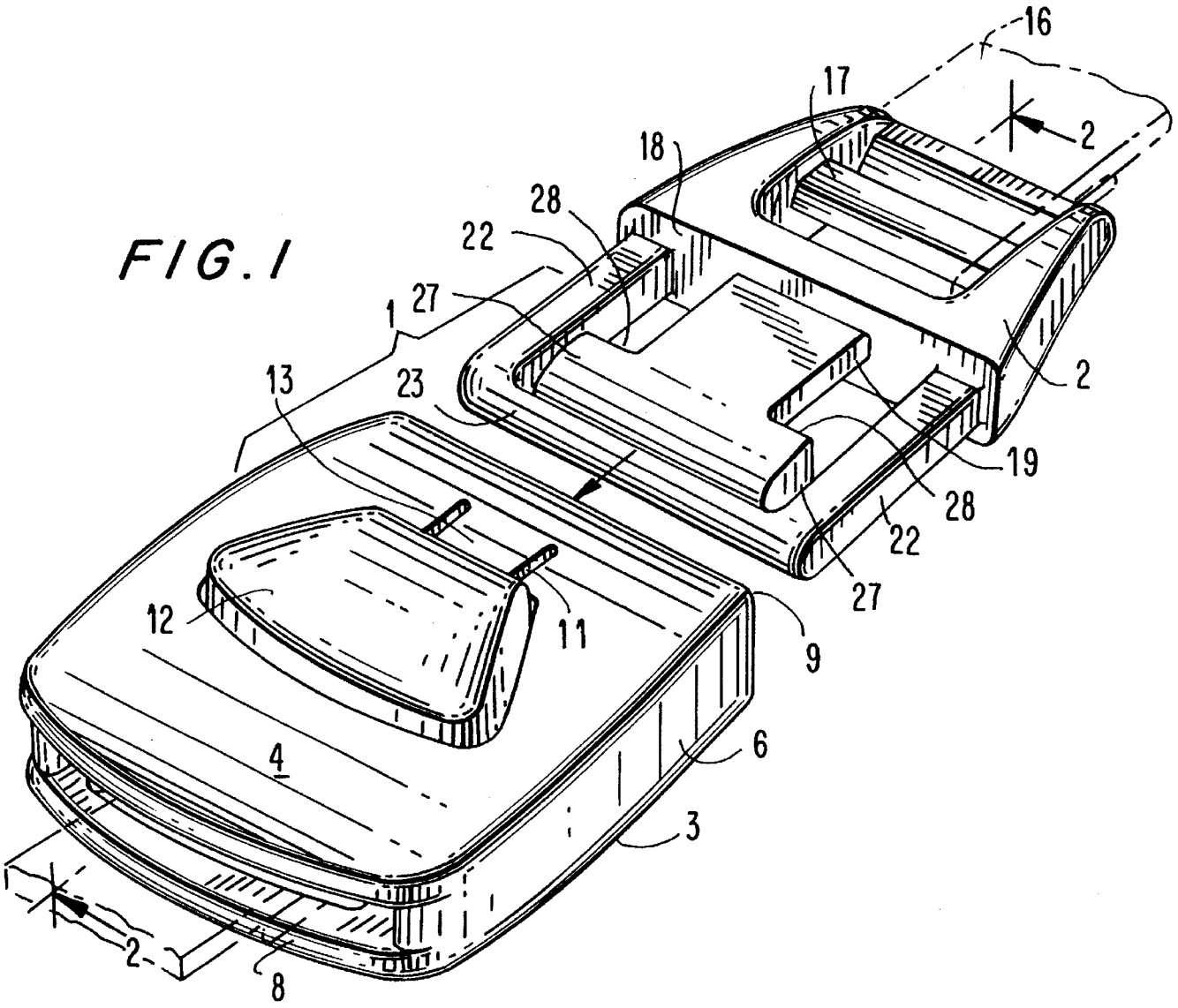
FIG. 1 is a perspective view of a plug member and a socket member of a two-piece buckle in accordance with the invention.

Referring to FIGS. 1–7, a two-piece buckle in accordance with the invention is generally illustrated at 1. The buckle 1 is preferably molded from some type of plastic or resin, but any suitable material known in the art for molding or machining buckles may be used. The buckle 1 includes a plug member 2 and a socket member 3 (see FIG. 1). The socket 3 includes a substantially planar top face 4, a substantially planar bottom face 5, side walls 6, 7 and a proximal end 8. The socket 3 is a relatively thin, flat member whose top 4 and bottom 5 faces are much larger than its side walls 6, 7. Opposite the proximal end 8 is an insertion opening 9 (see FIG. 2). The top 4 and bottom 5 faces enclose a compartment or guide chamber 10 therebetween (see FIG. 2) for receiving the plug member 2. The insertion end of the socket member 3 is open and allows for entrance of the plug member into the compartment or guide chamber 10.

A portion of the top face 4 of the socket member 3 is cut along a line 11 so as to define a resilient button or flap 12. In this embodiment, the cutaway line 11 terminates at two points just before the distal end 9 of the socket to leave a region 13 along which the flap 12 remains connected to the top wall 4. This area of connection functions essentially as a hinge 13 about which the flap 12 can pivot. The cavity 10 in the socket 3 is open and unobstructed in the region between the flap 12 and the bottom face 5 to permit pushing movement of the flap toward the interior of the socket (see FIG. 2). As known in the art, the buckle may be molded from any resin which would allow for resilient flexibility of the flap 12 about hinge area 13, such as polypropylene.

The bottom face 5 of the socket member 3 has a pair of transverse slots 14 (illustrated in FIGS. 4 and 5) therein, extending between sides 6 and 7. Slots 14 define a crossbar 15 therebetween. The end of a strap or belt 16 may be threaded through the slots 14 and wrapped around crossbar 15. The strap 16 may be stitched to itself to permanently secure it to the crossbar 15.

The plug member 2 includes a proximal base portion 18 from which a resilient tongue 19 extends distally. The tongue 19 is of a greatly reduced thickness relative to the base 18 so that it may be inserted into the guide chamber 10 of the socket 3 through insertion opening 9. However, the proximal base 18 of the plug 2 has approximately the same width from side to side and thickness from top to bottom as the socket member so that when the plug is coupled to the socket, the top and bottom faces and the sides thereof are contiguous and smooth giving the two-piece buckle a smooth and streamlined appearance (see FIGS. 3 and 5). The tongue 19 is resiliently flexible from the point from which it extends from the base 18.

The distal end of the tongue 19 is formed with a pair of laterally projecting wings 27, each of which defines a shoulder 28 on its proximal side. The wings impart a T-shape to the tongue 19, as illustrated in FIG. 1. The wings 27 function as latches to lock the plug member in the socket member, as will be explained below.

The male plug member 2 includes a pair of crossbars 17 and 21 at its proximal end which can receive another end of the strap 16 in a well known manner such that the strap 16 is adjustable, for example, as described in my U.S. Pat. No. 5,216,786. Alternatively, the pair of crossbars may be provided on the female socket member and the single crossbar may be provided on the male member, or both the male and the female members may include a single crossbar, in which event strap 16 would not be adjustable.

A pair of legs 22 project from the base 18 in a distal direction, and run along opposite sides of the tongue 19. Legs 22 function as guide members for properly positioning the plug member in the socket, and for providing a snug fit within guide chamber 10. The distal ends of legs 22 may be joined by cross member 23 to define a guide rail around the perimeter of the tongue and wings, for enhanced structural integrity of the buckle.

Figure 2:
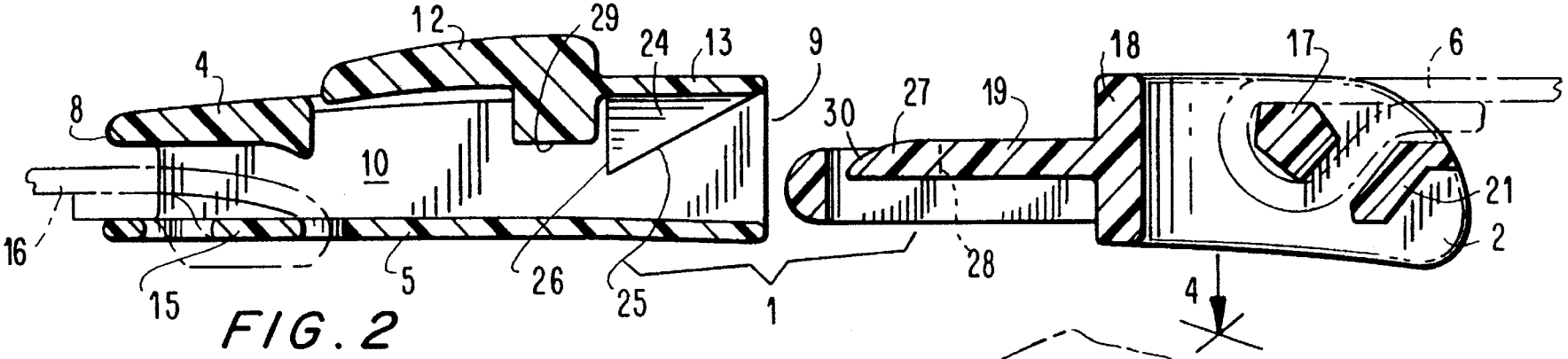
FIG. 2 is a cross-sectional view of the buckle of FIG. 1 taken along line 2—2.
Figure 3:
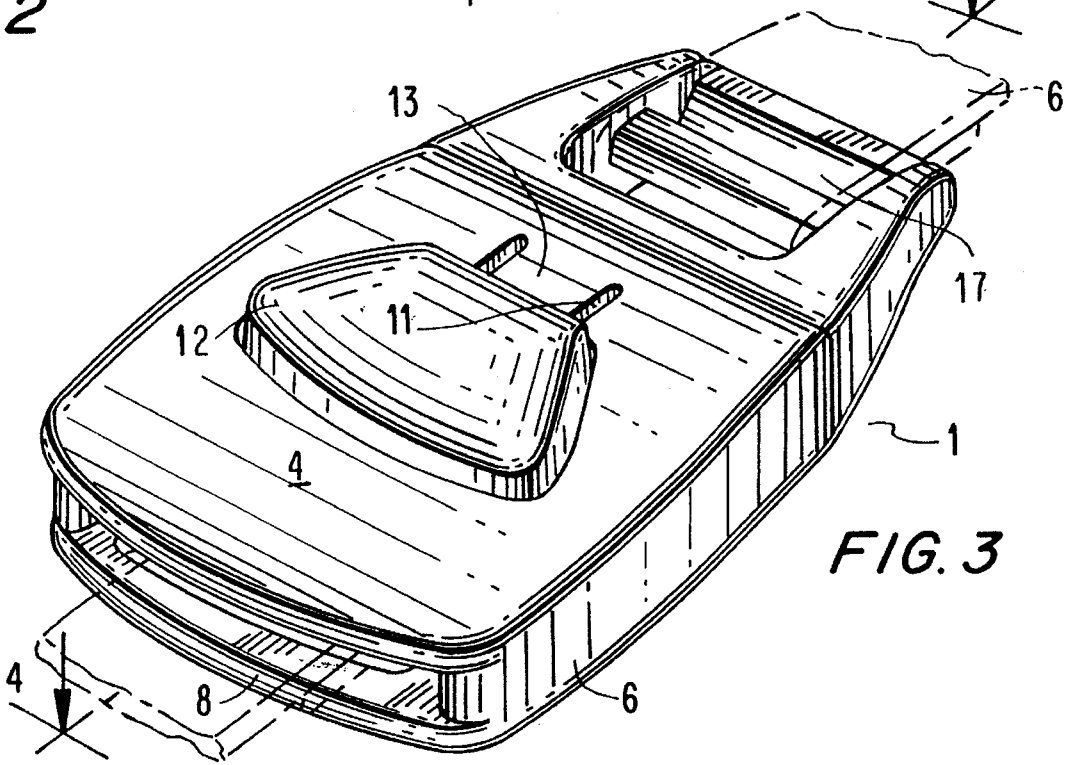
FIG. 3 is a perspective view of the two-piece buckle of FIG. 1 wherein the plug and socket are coupled to each other.
Figure 4:
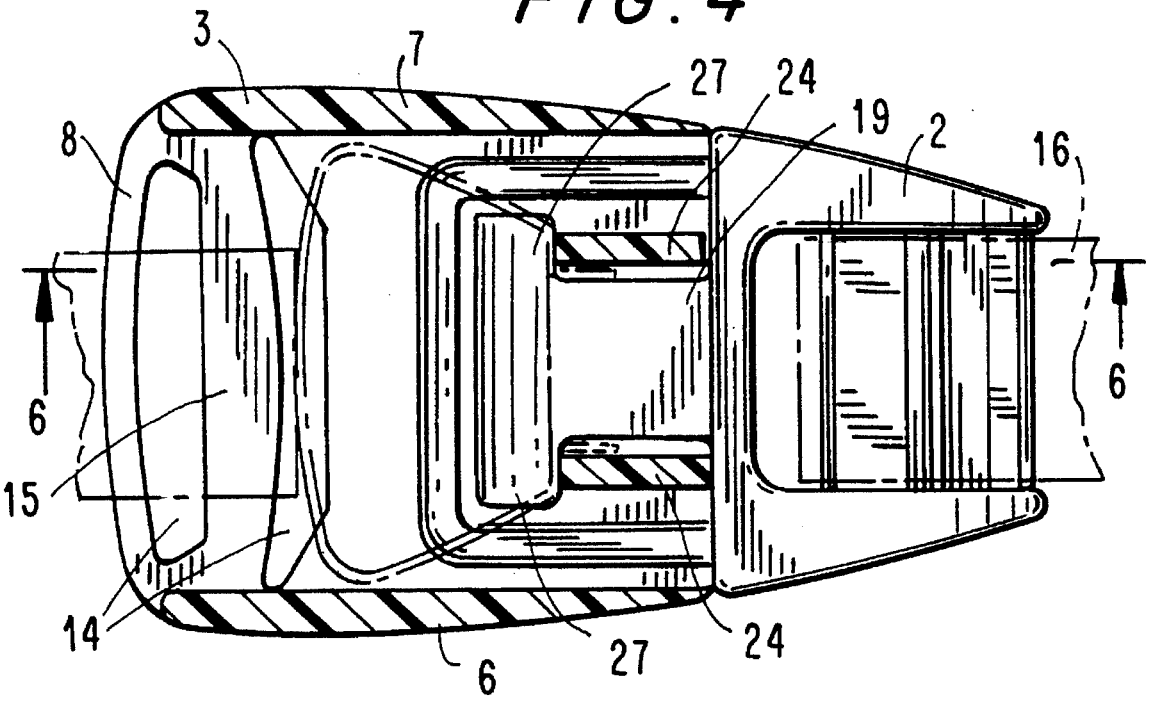
FIG. 4 is a cross-sectional view of the buckle of FIG. 3 taken along the line 4—4.
Figure 5:
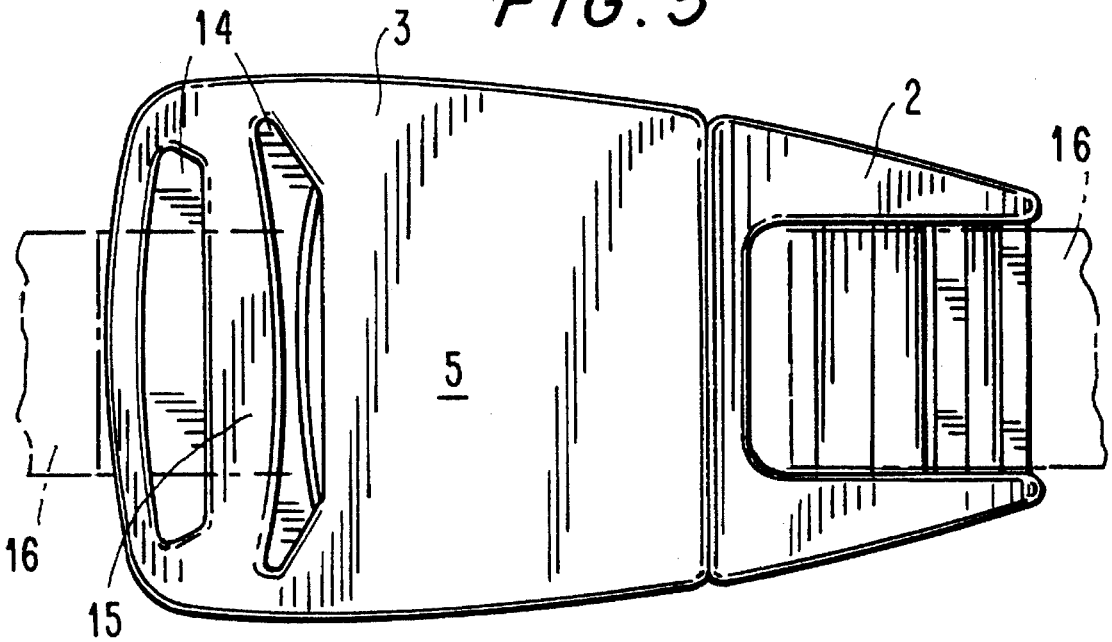
FIG. 5 is a bottom planar view of the buckle of FIG. 3.
Figure 6:
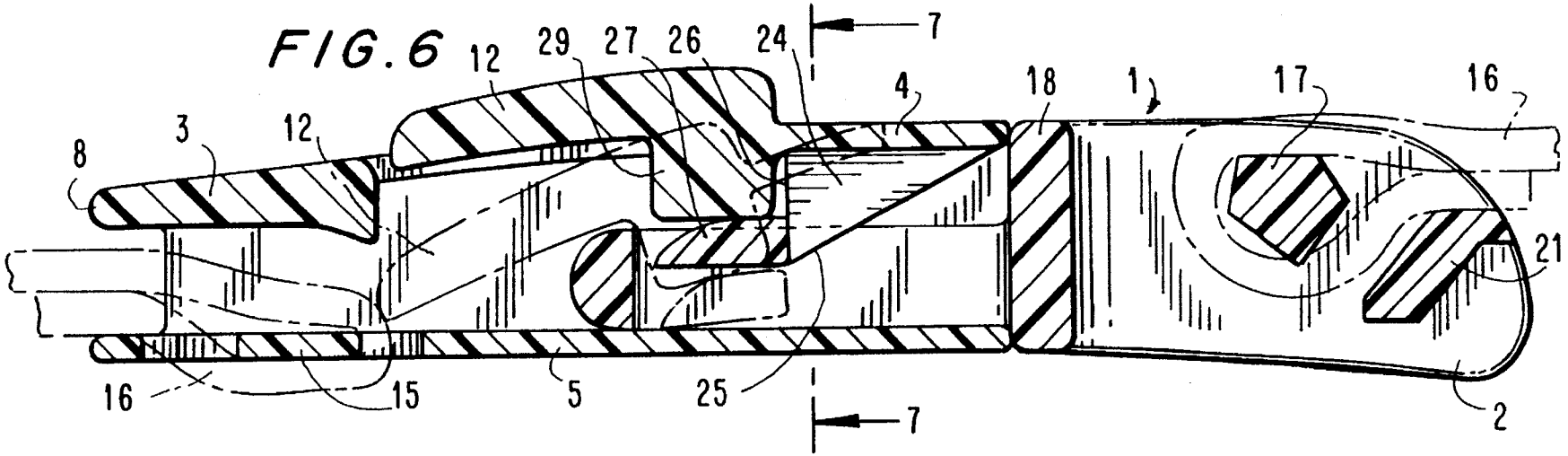
FIG. 6 is a cross-sectional view of the buckle of FIG. 4 taken along the line 6—6, except it also shows, in phantom, the flap or hinged member being depressed to disengage the tongue from the lug.
Figure 7:
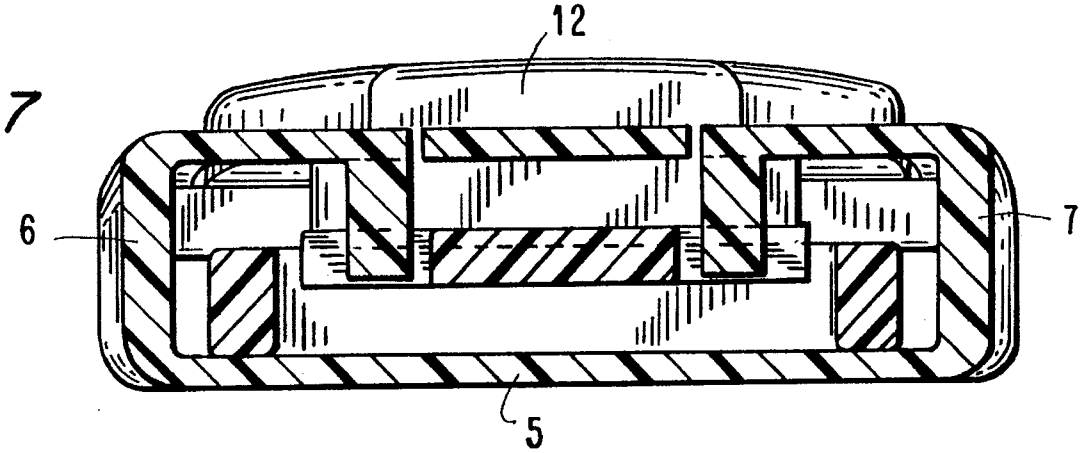
FIG. 7 is a cross-sectional view of the buckle of FIG. 6 taken along the line 7—7.
Figure 8:
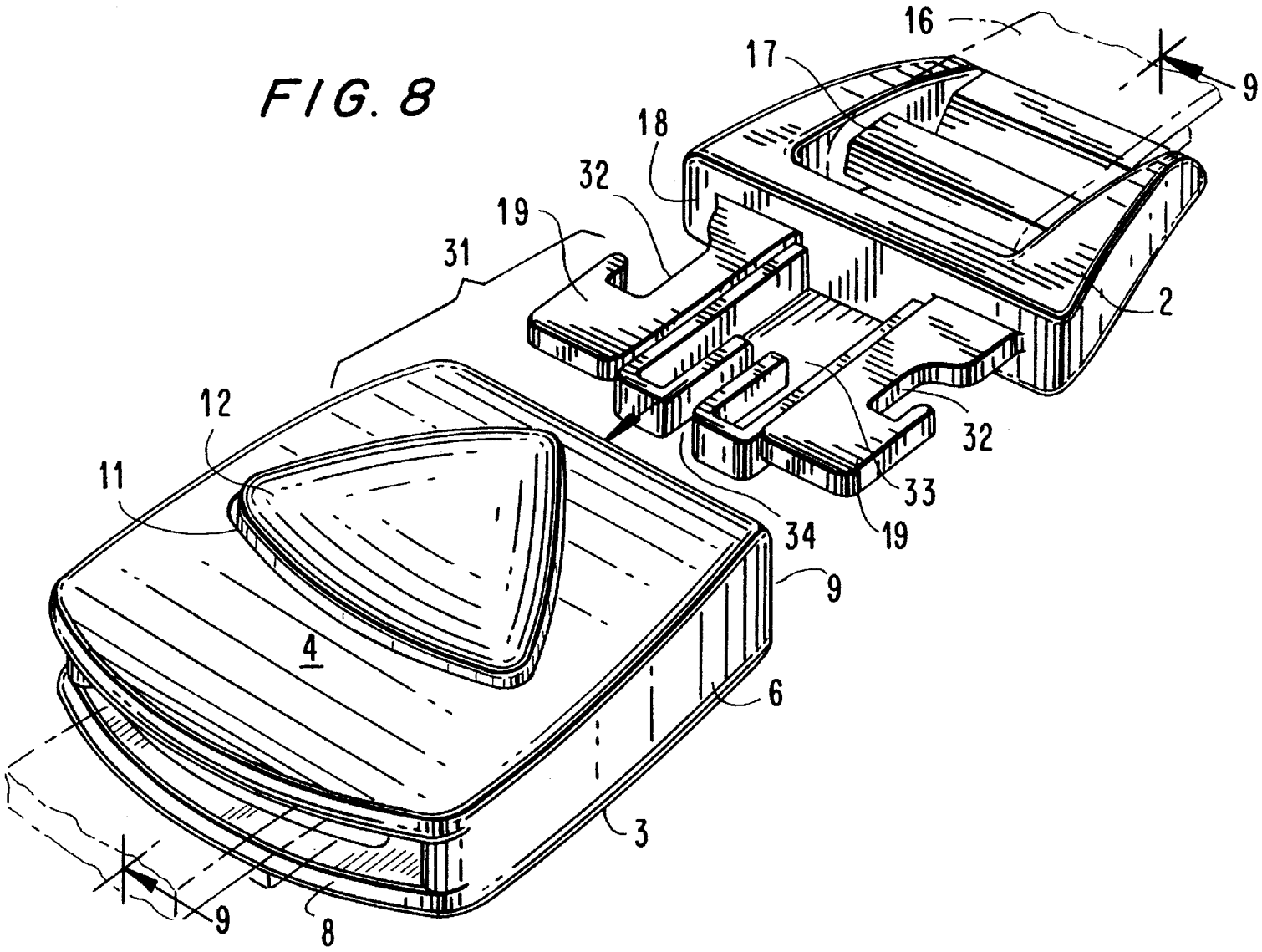
FIG. 8 is a perspective view of a two-piece buckle in accordance with another embodiment of the invention showing the plug member decoupled from the socket member.
Figure 9:
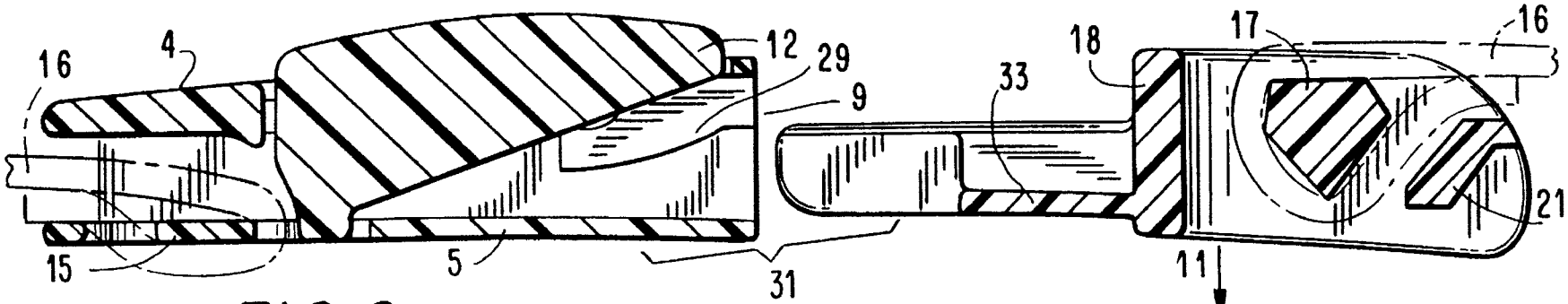
FIG. 9 is a cross-sectional view of the buckle of FIG. 8 taken along the line 9—9.
Figure 10:
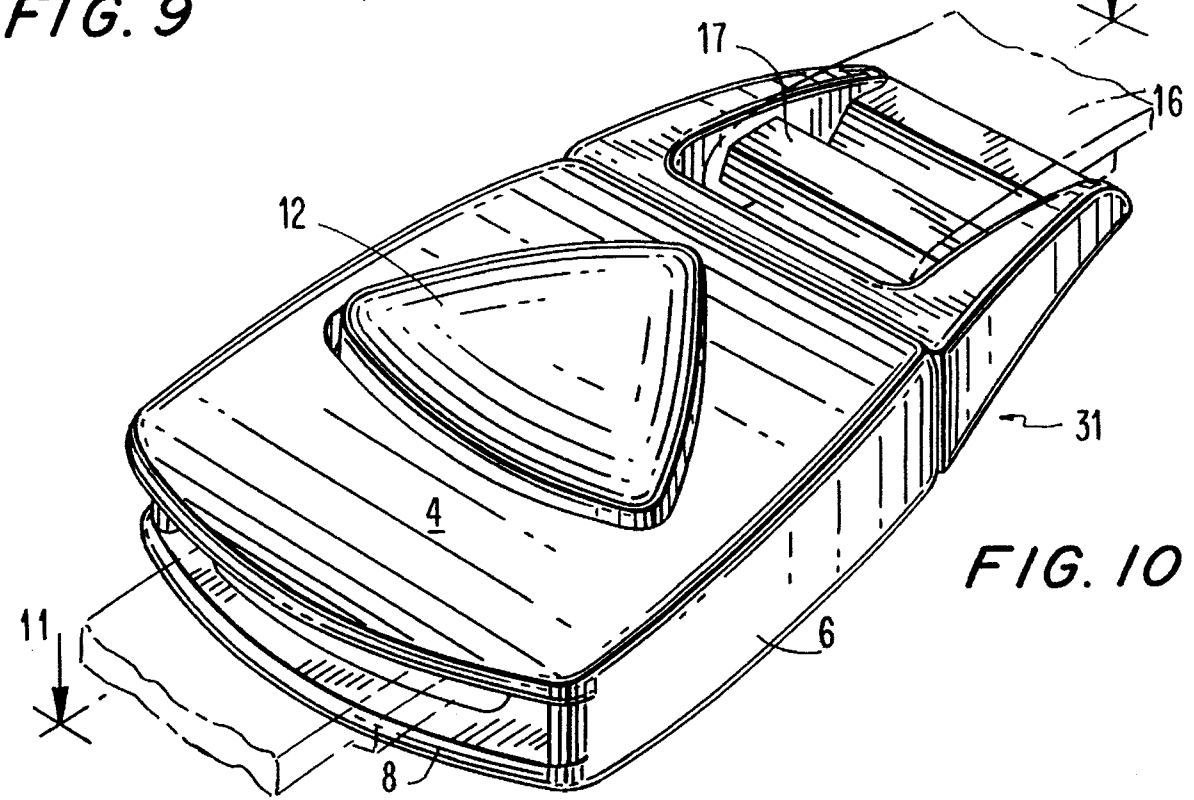
FIG. 10 is a perspective view of the buckle of FIG. 8 wherein the plug member is coupled to the socket member.
Figure 11:
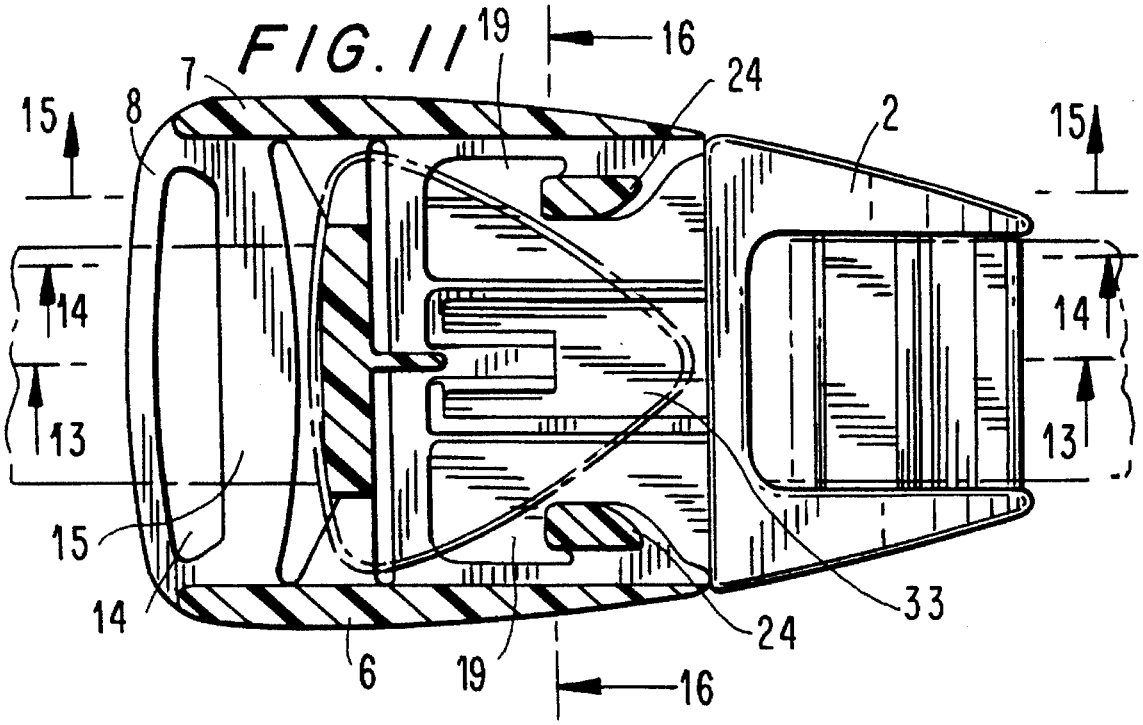
FIG. 11 is a cross-sectional view of the buckle of FIG. 10 taken along the line 11—11.
Figure 12:
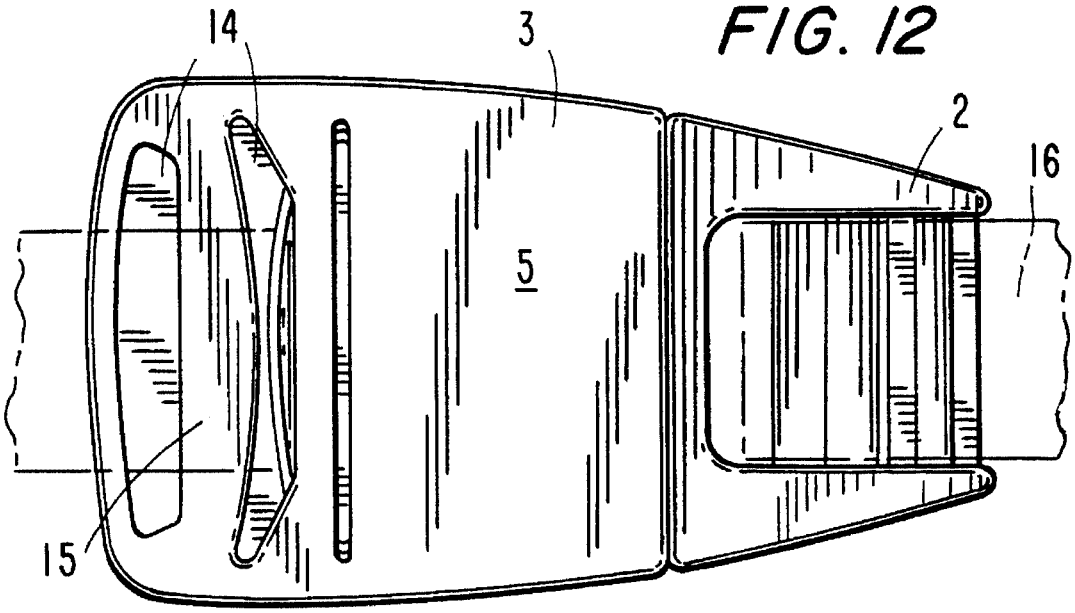
FIG. 12 is a bottom planar view of the buckle of FIG. 10.
Figure 13:
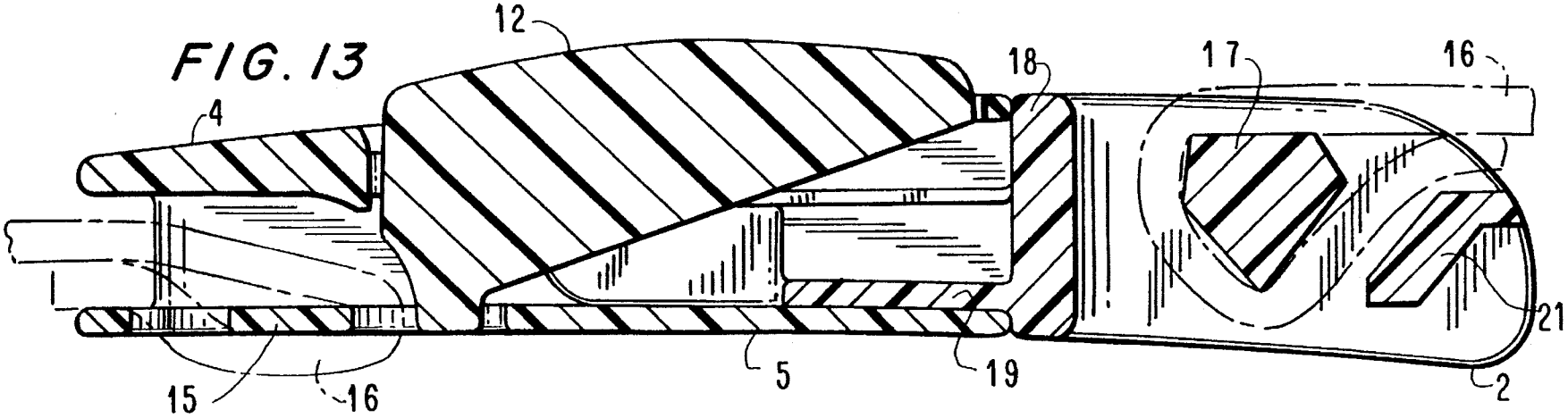
FIG. 13 is a cross-sectional view of the buckle illustrated in FIG. 11 taken along the line 13—13.
Figure 14:
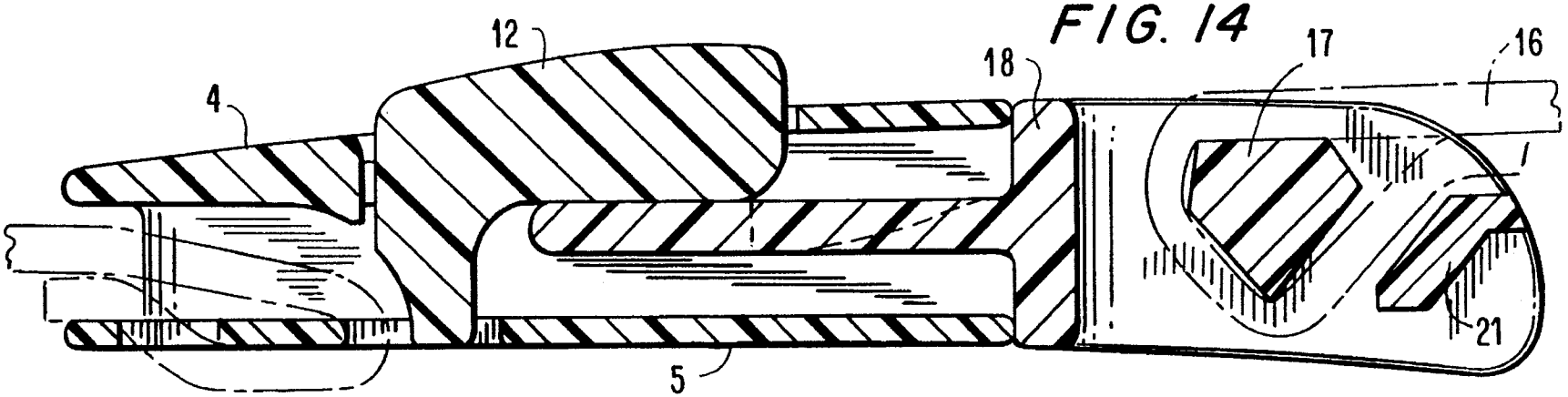
FIG. 14 is a cross-sectional view of the buckle illustrated in FIG. 11 taken along the line 14—14.
Figure 15:
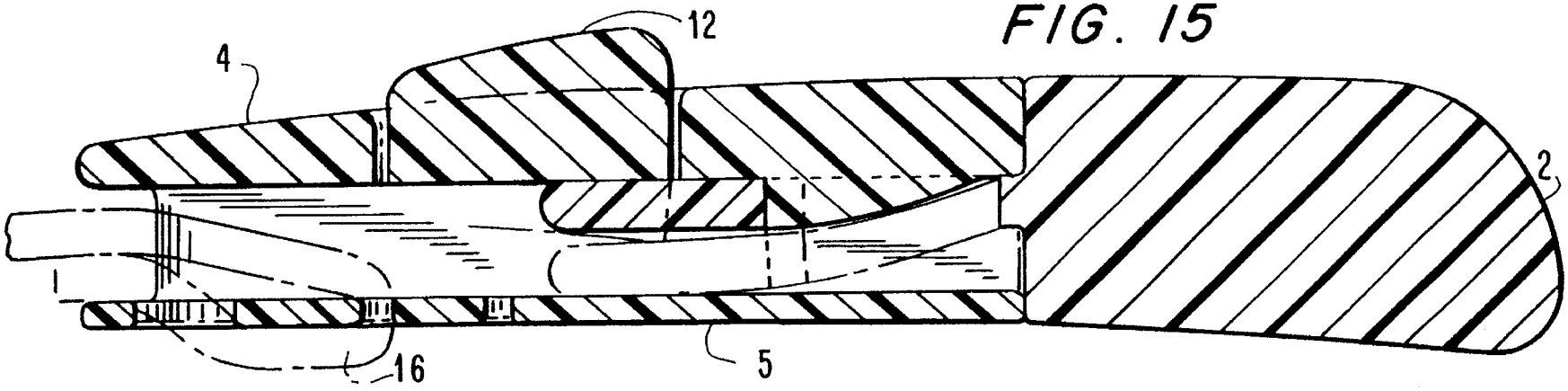
FIG. 15 is a cross-sectional view of the buckle illustrated in FIG. 11, except it also illustrates, in phantom, the hinged member being depressed.
Figure 16:
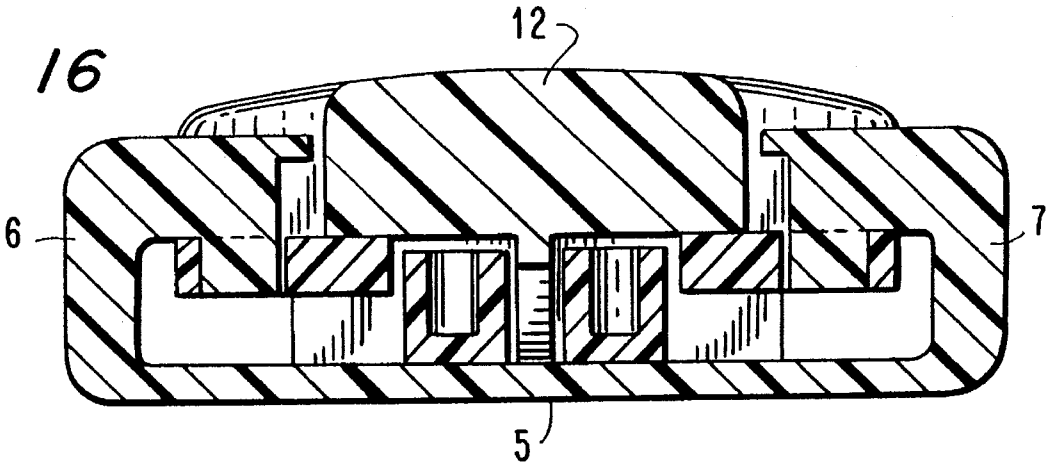
FIG. 16 is a cross-sectional view of the buckle of FIG. 11 taken along the line 16—16.

The inner surface of the top face 4 of the socket member 3 includes a pair of locking lugs 24 which project into cavity 10 (see FIGS. 2, 4 and 6). The locking lugs 24 are not located on the flap 12. Rather, they are positioned on opposite sides of the cutaway line 11 which defines the border of the hinge region 13, and they are spaced far enough apart such that they can engage the wings 27 on opposite sides of the tongue 19 when the plug member is coupled to the socket member. The locking lugs 24 have a distal side surface 25 which is preferably canted in a direction so as to form a downhill slope in the direction from the proximal end 8 of the socket toward the distal insertion end 9 of the socket for reasons which will be discussed below (see FIGS. 2 and 6). Opposite the distal side surface 25 of each lug 24 is a proximal side surface 26 which is normal to the inner surface of the top wall 4, and which is adapted to lockingly engage the shoulder 28 belonging to the corresponding wing 27 of the plug member when the plug member is fully inserted in the socket member.

To couple the two buckle pieces together, the tongue 19 of the plug member 2 is inserted through the opening in the distal insertion end 9 of the socket 3. When the wings 27 of the tongue 19 engage the locking lugs 24, the canted surfaces 25 of the locking lugs will force the resiliently flexible tongue downward until the shoulders 28 move past the surfaces 26 of the locking lugs and completely clear the locking lugs. In this position, the wings 27 will be free to slide up over the normal surfaces 26 of the locking lugs 24 and the resilient tongue will be free to move back toward its non-flexed position thereby locking the plug and socket together.

To release or uncouple the plug member 2 from the socket member 3, one simply presses down on the button or flap 12 to force it into the guide chamber 10 and into contact with tongue 19 (see FIG. 6). The movement forces tongue 19 downward and away from locking lug 24 so as to free shoulders 28 from normal surfaces 26. As soon as shoulders 28 clear surfaces 26, the spring force which will be exerted by the now flexed resilient tongue 19 will urge the tongue outward in a direction away from the locking lug 24. This movement is facilitated by the canted surface 25 of the locking lug which is sloped so as to permit the tongue to slide over it. Buckle separation may also be greatly facilitated by configuring the top of the wings 27 to have a canted surface 30 (see FIG. 2) such that it has a downhill slope from the proximal to distal direction of the wings.

Preferably, the inside surface of the flap 12 which faces cavity 10 has a releasing member or projection 29 which extends into cavity 10 to just make contact with the tongue 19 when the flap is not depressed. This has the advantage of not having to depress the flap to a great extent in order to disengage the shoulders 28 from the locking lug 24.

FIGS. 8–16 illustrate another embodiment of a two-piece buckle in accordance with the invention. In the drawings, like reference numerals are used to identify parts or features which correspond to those in the previously described embodiment. This buckle 31 also includes a plug member 2 and a socket member 3. The socket member 3 has an open distal insertion end 9. The resilient flap or button 12 is once again a cutaway region in the top face 4 of the socket along a line 11. The locking lugs 24 are located on opposite sides of the flap 12, on the inside of the socket.

The plug member 2 includes a base portion 18 from which a pair of resilient tongues 19 project distally. The tongues 19 run along opposite sides of the plug member. Each tongue is configured to define a hook 32 in a position where it can engage a locking lug when the plug is fully inserted into the socket. The base portion 18 of the plug 2 may include a single crossbar, or a pair of upper and lower crossbars 17, 21, as illustrated, for adjustably coupling a strap 16. The bottom surface 5 of the socket member 3 includes a single crossbar for securing the other end of the strap 16.

The plug member 2 preferably includes a third tongue 33 projecting from base portion 18, and situated between tongues 19. The tongue 33 can function to guide and properly orient the plug in the socket. The tongue 33 may be partitioned to define a channel 34 to save resin or plastic raw material.

To assemble the buckle, the plug 2 is inserted into the insertion end 9 of the socket 3, as described above with respect to the first embodiment. Each resilient tongue 19 will be flexed downwardly as it slides over each locking lug 24 until each hook region 32 is aligned with each locking lug, whereupon the tongue 19 will be free to return to its original position, thereby locking each hook 32 on its respective lug 24.

To release or uncouple the plug member 2 from the socket, the button 12 is depressed which causes it and engaging projections 29 to move each resilient tongue 19 downward and away from each locking lug 24 until each hook 32 clears each lug. The forces exerted by the resilient tongues 19 now urge each plug outward from the socket to open the buckle.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A buckle comprising:

a socket member having an obverse face and a pair of longitudinally disposed sides, wherein the obverse face and the sides define a socket therebetween, the socket member having an open end;

a flap belonging to the socket member, the flap being resiliently flexible and pivotable about a region of attachment of the flap to the socket member, and the flap being depressible to a location in which it projects inside the socket;

a pair of stop members projecting from an inner surface of the obverse face toward the interior of the socket; and a plug member having a base portion and a resilient tongue projecting from the base portion in the longitudinal direction, the tongue having a means for locking the plug member to the stop members of the socket member, the means for locking consisting of a pair of laterally projecting wings, each wing defining a shoulder thereon, wherein the socket member is adapted to slidably receive the tongue, along the longitudinal direction, through the open end of the socket member, so as to couple the socket member and the plug member, and wherein the stop members are adapted to engage the shoulders defined by the wings for locking the plug member to the socket member when the plug member is coupled to the socket member, and wherein the plug member may be unlocked from the socket member by depressing the flap toward the interior of the socket to force the resilient tongue into the socket and disengage the shoulders from the stop members thereby permitting decoupling of the plug member and the socket member.

2. The buckle according to claim 1 wherein the flap is pivotable along a line which is transverse to the longitudinal direction of the sides of the socket member.

3. The buckle according to claim 1 wherein the plug member further includes a guide rail extending from the base portion and arranged around the tongue.

4. The buckle according to claim 3 wherein each stop member is a lug.

5. The buckle according to claim 4 wherein each lug has a distal face which is canted in a direction to permit sliding movement of the tongue over the distal face when the tongue is inserted into the socket.

6. The buckle according to claim 5 wherein each lug has a proximal surface which is normal to the inner surface of the obverse face of the socket.

7. The buckle according to claim 1 wherein each stop member is a lug.

8. The buckle according to claim 7 wherein each lug has a distal face which is canted in a direction to permit sliding movement of the tongue over the distal face when the tongue is inserted into the socket.

9. The buckle according to claim 8 wherein each lug has a proximal surface which is normal to the inner surface of the obverse face of the socket.

10. The buckle according to claim 1 further comprising a releasing member projecting toward the interior of the socket from an inner surface of the flap for engaging the tongue upon depression of the flap.

11. A buckle comprising:

a socket member having an obverse face and a pair of longitudinally disposed sides, wherein the obverse face and the sides define a socket therebetween, the socket member having an open end;

a flap belonging to the socket member, the flap being resiliently flexible and pivotable about a region of attachment of the flap to the socket member, and the flap being depressible to a location in which it projects inside the socket;

a pair of stop members projecting from an inner surface of the obverse face toward the interior of the socket; and a plug member having a base portion and a pair of resilient tongues projecting from the base portion in the longitudinal direction, each tongue defining a hook, wherein the socket member is adapted to slidably receive the tongue, along the longitudinal direction, through the open end of the socket member, so as to couple the socket member and the plug member, and wherein the stop members are adapted to engage and latch onto the hooks defined in the tongues for locking the plug member to the socket member when the plug member is coupled to the socket member, and wherein the plug member may be unlocked from the socket member by depressing the flap toward the interior of the socket to force the resilient tongues into the socket and disengage the hooks from the stop members thereby permitting decoupling of the plug member and the socket member.

12. The buckle according to claim 11 wherein the plug member further includes a guide tongue extending from the base portion and situated between the resilient tongues defining the hooks.

13. The buckle according to claim 12 wherein each stop member is a lug.

14. The buckle according to claim 13 wherein each lug has a distal face which is canted in a direction to permit sliding movement of the tongue over the distal face when the tongue is inserted into the socket.

15. The buckle according to claim 14 wherein each lug has a proximal surface which is normal to the inner surface of the obverse face of the socket.

16. The buckle according to claim 11 wherein each stop member is a lug.

17. The buckle according to claim 16 wherein each lug has a distal face which is canted in a direction to permit sliding movement of the tongue over the distal face when the tongue is inserted into the socket.

18. The buckle according to claim 17 wherein each lug has a proximal surface which is normal to the inner surface of the obverse face of the socket.

19. The buckle according to claim 11 further comprising releasing members projecting toward the interior of the socket from an inner surface of the flap for engaging the resilient tongues defining the hooks upon depression of the flap.

* * * * *